US005471776A

United States Patent [19]

Chesnut et al.

[11] Patent Number: 5,471,776

[45] Date of Patent: Dec. 5, 1995

[54] METHOD AND APPARATUS FOR ATTACHMENT OF A RECOIL PAD ASSEMBLY

[75] Inventors: M. Gaines Chesnut, Hamilton; Marc Ulasik, Clifton, both of Colo.

[73] Assignee: Blount, Inc., Montgomery, Ala.

[21] Appl. No.: 2,853

[22] Filed: Jan. 13, 1993

Related U.S. Application Data

[63] Continuation-in-part of Ser. No. 817,013, Jan. 3, 1993, Pat. No. 5,235,765.

[51] Int. Cl.[6] ..... F41C 23/08

[52] U.S. Cl. ..... 42/74

[58] Field of Search ..... 42/74, 71.01

[56] References Cited

U.S. PATENT DOCUMENTS

| | | | |
|---|---|---|---|
| 426,916 | 4/1890 | Cash et al. | 42/74 |
| 1,328,924 | 1/1920 | Kennedy | 42/74 |
| 1,642,835 | 9/1927 | Ammann | 42/74 |
| 2,187,548 | 1/1940 | Smith | 42/74 |
| 3,147,562 | 9/1964 | Pachmayr et al. | 42/74 |
| 3,160,976 | 12/1964 | Pachmayr | 42/74 |
| 3,208,180 | 9/1965 | Woodcock | 42/74 |
| 3,363,352 | 1/1968 | Pachmayr | 42/74 |
| 3,604,138 | 9/1971 | Wilson | 42/74 |
| 3,609,903 | 10/1971 | Pachmayr et al. | 42/74 |
| 3,696,544 | 10/1972 | Webb | 42/74 |
| 3,852,904 | 12/1974 | Drevet | 42/74 |
| 4,887,374 | 12/1989 | Santarossa | 42/74 |

FOREIGN PATENT DOCUMENTS

| | | | |
|---|---|---|---|
| 1910375 | 9/1970 | Germany | 42/74 |

OTHER PUBLICATIONS

Pachmayr Announces All–New "Quick–Change Recoil Pad System".

"Ram–Line Unique by Design Accessories '89" Copyright 1988.

"Arrestor Pad Base" dated Feb. 10, 1988 by Brian T. Boyd.

"Hunter Shooting Accessories 1991 Catalogue" Copyright 1990.

*Primary Examiner*—Stephen M. Johnson

*Attorney, Agent, or Firm*—Sheridan Ross & McIntosh

[57] ABSTRACT

A recoil pad assembly is provided for attachment to a firearm stock. The recoil pad assembly includes a recoil pad, which includes a rib extending along the outer edge of its base. The rib is disposed adjacent a wall of a base plate shaped to receive the recoil pad. A locking plate, disposed within the recoil pad, is forced downward by fastening screws which extend through the base plate and into the stock of a firearm. When the locking plate is forced to be flushed with a lower wall of the base plate, the rib of the recoil pad is held between the two. The base plate is provided with a plurality of apertures into which portions of the rib are forced, thereby locking the recoil pad into place.

19 Claims, 15 Drawing Sheets

METHOD AND APPARATUS FOR ATTACHMENT OF A RECOIL PAD ASSEMBLY

RELATED APPLICATIONS

This is a continuation-in-part of U.S. patent application Ser. No. 07/817,013, filed Jan. 3, 1993 now U.S. Pat. No. 5,235,765.

FIELD OF THE INVENTION

The present invention relates to a recoil pad for use in absorbing a recoil force generated by shooting a firearm.

BACKGROUND OF THE INVENTION

A rifle or shotgun when fired generates a recoil force. Typically, such a firearm is positioned against the shoulder of the shooter. The recoil force is applied to the shoulder. To reduce the amount of the force applied when the firearm is used, firearms utilize recoil pads attached to the back of the stock of the firearm. Generally, at least a considerable part of the recoil pad is made of a resilient material, such as rubber. The resilient material is intended to absorb at least part of the generated recoil force so that the force applied to the shooter is reduced.

A major drawback associated with previously devised recoil pads concerns the requirement that they must be shaped or re-worked to fit the butt end of the firearm stock. More specifically, recoil pads made from rubber, for example, are typically oversized so that they are able to be modified to fit the butt ends of different firearm stocks that may vary somewhat in size. That is, because of costs and manufacturing considerations, it is usually not practical to make the recoil pad so that it exactly fits the butt ends of stocks, which may vary slightly from stock to stock. Instead, a common oversized recoil pad is manufactured and, when fitting the recoil pad to the particular stock, material is removed from about the outer surface of the recoil pad until the desired size for the particular stock is reached. This shaping or modification of the recoil pad is time-consuming and contributes to the cost thereof.

A further drawback associated with a substantial number of recoil pads relates to the discomfort experienced by the shooter due to the relative hardness of the recoil pad. When the firearm is fired, the recoil force is applied to the relatively hard recoil pad which is transmitted to the shooter's shoulder. Such recoil pads are uncomfortable and are not soft against the shooter's body or shoulder when the firearm is discharged.

Another aspect associated with recoil pads for which improvement is sought concerns the mechanism by which the recoil pad is attached to the stock of the firearm. Many recoil pads are attached using fastening screws or the like that are inserted through the top surface of the recoil pad. Because recoil pads are typically made of a rubber-like material, such material tends to permit the fastening screws to pull through or not remain in the recoil pad. Furthermore, in many cases, these recoil pads have the head of the fastening screw exposed at the top surface of the recoil pad, thereby detracting from the overall appearance thereof.

A number of prior art attachment schemes have been developed in which the fastening screws have been fully contained within the recoil pad; however these schemes require that the base of the recoil pad be molded around a rigid member which is then connected to the firearm stock. This complicates the manufacture of the recoil pad. In addition, these attachment schemes do not address the problem of having to re-work or fit the recoil pad to a specific firearm stock.

SUMMARY OF THE INVENTION

The present invention relates to a recoil pad assembly for overcoming drawbacks and other perceived deficiencies in prior art recoil pads. In that regard, the recoil pad assembly of the present invention includes three main sub-assemblies for providing desired functions and advantages.

The recoil pad assembly includes a recoil pad subassembly having a recoil pad section and a bracket attachment section. The recoil pad subassembly is made of a resilient material that is manipulatable for use in properly fitting it to a firearm stock. The bracket attachment section is integral with the recoil pad section and is located at the bottom of the recoil pad subassembly for connection to the butt end of the firearm stock. The recoil pad section includes a number of levels formed along the height of the recoil pad subassembly, which extends from a top surface thereof to the firearm stock. Each of the levels includes a plurality of cut-outs or openings with material layers, ribs and membranes interspersed among the cut-outs. The ribs are generally thin webs that are substantially parallel to the long axis of the recoil pad section. The membranes are generally thicker webs than the ribs and are substantially perpendicular to the long axis of the recoil pad section. The material layers are generally planar members that are interconnected by the ribs and membranes.

Preferably, three levels of cut-outs are provided. The first level of cut-outs, which is formed most adjacent to the top surface of the recoil pad subassembly, is arranged to enhance the relative softness of the recoil pad subassembly. This is accomplished, at least in part, by providing the ribs so that they are offset from the longitudinal center axis of the recoil pad subassembly. Consequently, not only is there sufficient strength for providing a cushion against the recoil force generated by a firearm when it is fired, desired softness and comfort is experienced by the shooter's shoulder. The second level of cut-outs is formed so that the ribs and membranes are advantageously offset relative the ribs and membranes associated with the first level of cut-outs. This contributes to the desired strength of the recoil pad subassembly. Similarly, the third level of cut-outs has ribs and membranes offset from the other two levels. The cut-outs, ribs and membranes are arranged to achieve a collapsing or compressing result when the recoil force from a firearm is generated. This arrangement and desired collapsing contributes to a reduction in force applied to the shoulder and an enhanced cushioning or softness effect felt by the shooter when the firearm is fired.

The recoil pad assembly also includes a containment bracket subassembly for use in fitting and connecting the recoil pad subassembly to the end of the firearm stock. This subassembly includes first and second containment brackets that are joined to the bracket attachment section. Each of the containment brackets includes a pair of connector ears that are received in connector slots formed in the bracket attachment section. More specifically, a connector ear from each of the two containment brackets is positioned in opposite sides of the same connector slot.

The recoil pad assembly further includes a mounting bar subassembly that is connected to the firearm stock. The mounting bar subassembly includes a base having an upper surface. The bracket attachment section also has a seat. The base and the upper surface are received by the seat. Located on opposite sides of the base are two ramp members, each having a ramping surface. Each ramping surface forms an angle relative to a plane that is parallel to the upper surface of the mounting subassembly. Preferably, the angle is about 5° but other angles could be utilized so long as the following function is achieved. In particular, in connecting the recoil pad subassembly and the containment brackets to the mounting subassembly, fastening screws are tightened through the connector ears to thereby draw the containment brackets together. In doing this, the containment brackets are moved or ramped downwardly and inwardly relative to the recoil pad subassembly to mechanically connect and properly fit the recoil pad subassembly to the firearm stock. This is accomplished by the moving engagement between the containment brackets and the ramping surfaces. Upon completion of the tightening of the fastening screws, the containment brackets are essentially flush with the outer surface of the firearm stock.

In another embodiment, an attachment scheme is presented for a recoil pad subassembly comprising a recoil pad, a locking plate, a foam insert, a base plate and fastening screws. In this embodiment, the means for attaching the recoil pad to the stock of a firearm is contained within the recoil pad itself. The locking plate is forced downward by the fastening screws to pinch the lower edge of the recoil pad between itself and the side wall of the base plate. The base plate is provided with a plurality of apertures which allow the lower edge of the recoil pad to be forced outward and downward into the apertures, thereby locking it in place. This embodiment also accounts for slight variations in the size of firearm stocks without necessitating the grinding or re-working of the recoil pad.

In view of the foregoing, a number of objectives and/or advantages of the present invention are achieved. A recoil pad assembly is disclosed for cushioning against forces generated by a firearm using a number of levels of structurally uniquely arranged cut-outs, ribs and membranes. This arrangement provides the necessary strength for receiving fasteners, for use in absorbing forces generated by the firearm and for also contributing to enhanced comfort and softness felt by the shooter when the firearm is fired. The arrangement of cut-outs, ribs and membranes also presents an aesthetically pleasing appearance and design. The containment brackets, coupled with the ramping surfaces, facilitate connection of the recoil pad assembly to the firearm stock. Moreover, this construction permits essentially the same recoil pad assembly to be properly fitted and held by somewhat or slightly different sizes of ends of firearm stocks. Thus, the requirement that oversized recoil pads be modified is substantially avoided because the need to grind or remove recoil pad material from over-sized recoil pads is reduced, since the recoil pads of the present invention are manufactured at a size for more readily fitting the butt end of the stock, particularly when used with the containment brackets and ramping surfaces.

In addition, the attachment scheme of the present invention involving a locking plate also reduces the need for modification of oversized recoil pads. This embodiment also obviates the aesthetic problem of having fastening screws exposed by containing the fastening screws entirely within the recoil pad structure once it is fully assembled.

Additional advantages of the present invention will become readily apparent from the following discussion, particularly when taken in conjunction with the accompanying drawings.

DETAILED DESCRIPTION

Figure 1:
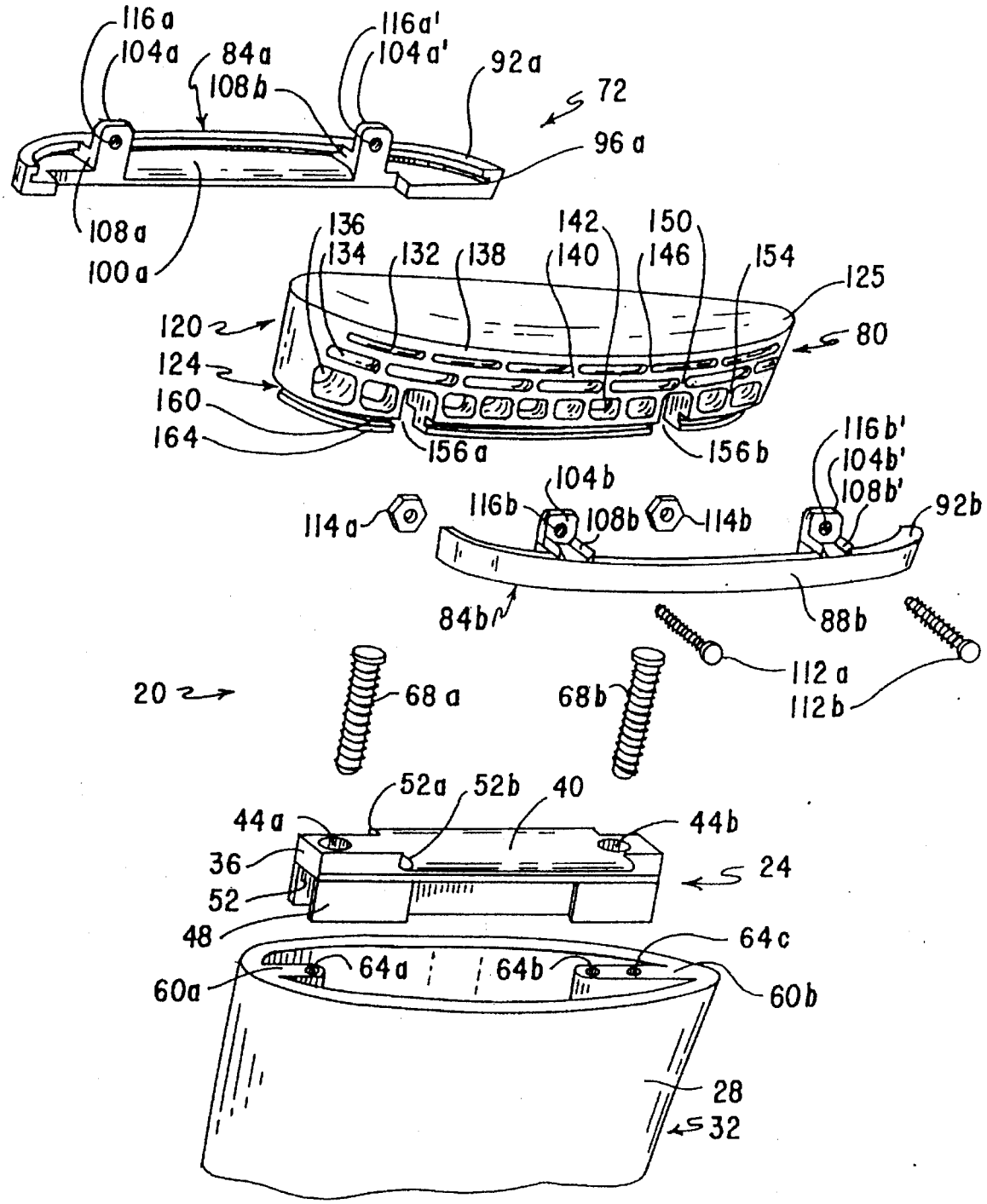
FIG. 1 is an exploded view of the recoil pad assembly of the present invention.
Figure 7:
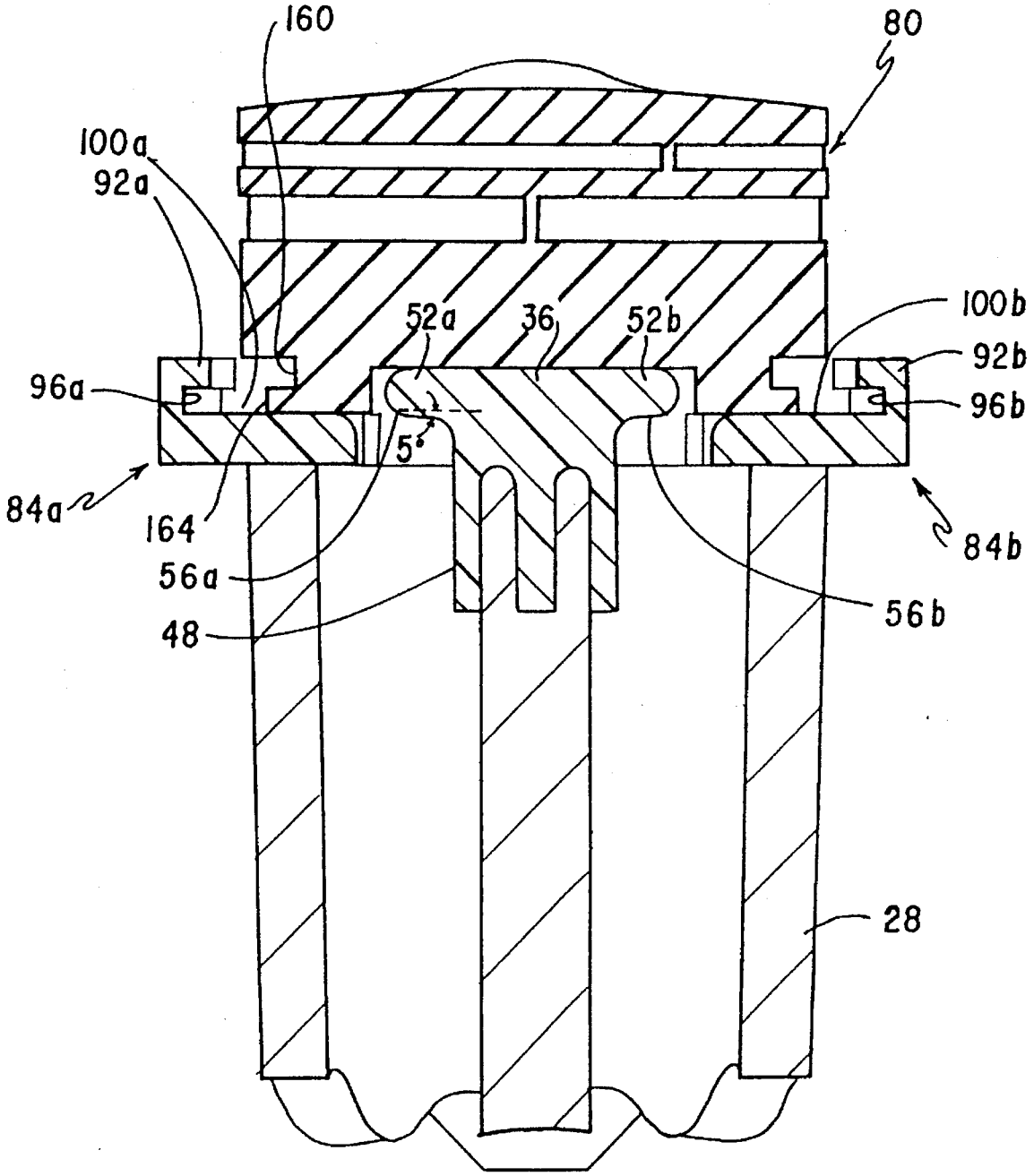
FIG. 7 is a lateral cross-sectional view of a first position of the containment brackets relative to the ramping surfaces used to connect the recoil pad subassembly and containment brackets to the firearm stock.

In accordance with the present invention, a recoil pad assembly 20 is illustrated in FIG. 1. The recoil pad assembly includes a mounting bar subassembly 24 that is adapted to be connected to the butt or back end of stock 28 of a firearm 32. The mounting bar subassembly 24 includes a body 36 having a support face 40. Holes **44*a*, 44*b* are formed through the body 36. Integrally formed with the body 36 and extending outwardly therefrom is a base 48 having a channel 52 formed within the base. Important to the attachment related feature of the present invention, the mounting subassembly 24 includes a pair of ramp members 52*a*, 52*b*** located on opposite sides of the body 36. Each of the ramp members 52*a*, 52*b* has a ramping surface 56*a*, 56*b*, respectively, as illustrated in FIG. 7. In one embodiment, the ramping surface forms an angle of 5° with a plane parallel to the support face 40.

In conjunction with the attachment of the mounting bar subassembly 24 to the stock 28, the channel 52 is positioned over first and second connecting pieces 60*a*, 60*b* integrally formed with the stock 28. The first connecting piece 60*a* has a bore 64*a* and the second connecting piece 60*b* has a bore 64*b*. In one embodiment, the second connecting piece 60*b* has another or third bore 64*c*. The third bore 64*c* is used with the stock 28 to facilitate connection of prior art recoil pads to the prior art stock 28. In connecting the mounting subassembly 24 to the stock 28, the holes 44*a*, 44*b* are aligned with the bores 60*a*, 60*b*, respectively, while the connecting pieces 60*a*, 60*b* are received in the channel 52. After proper alignment, connecting screws 68*a*, 68*b* are positioned through hole 44*a*, bore 60*a* and hole 44*b*, bore 60*b*, respectively, in order to connect the mounting bar subassembly 24 to the stock 28. The connecting pieces of the firearm stock need not be integrally formed therewith. For example, the connecting pieces may be solid so that bores can be drilled to match the holes of the particular recoil pad, which is to be affixed to the stock.

Figure 2:
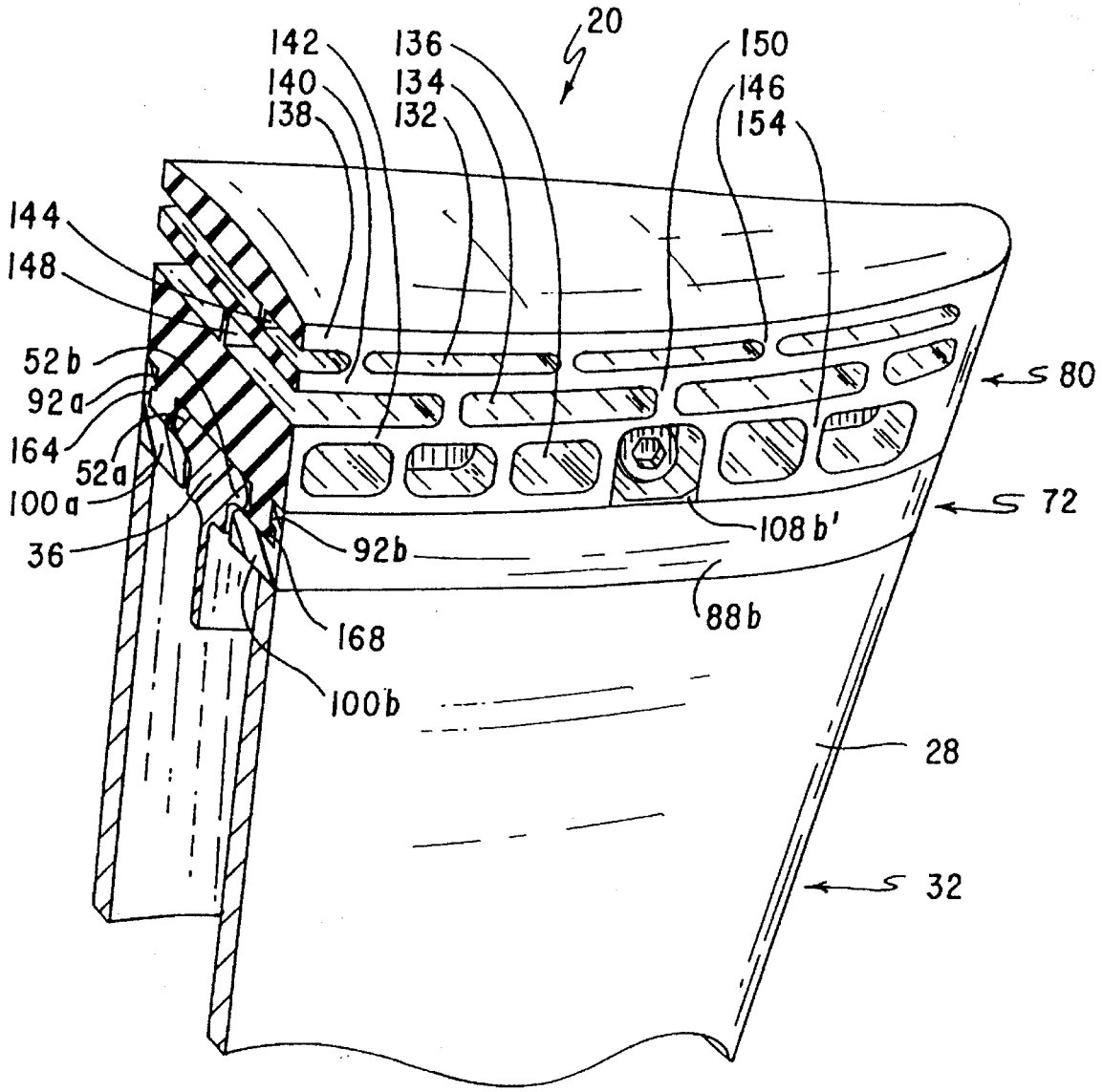
FIG. 2 is a perspective view showing a lateral cross-section illustrating the interconnection among the containment brackets and the mounting subassembly.

The recoil pad assembly 20 further includes a containment bracket subassembly 72 for desirably fitting and connecting a recoil pad subassembly 80 to the mounting subassembly 24 and thereby to the stock 28. The containment bracket subassembly 72 includes first and second containment brackets 84*a*, 84*b*. Each of the first and second containment brackets 84*a*, 84*b* has a construction that is equivalent to the other containment bracket. Consequently, for each element or item described in connection with one of the two brackets 84*a*, 84*b*, it will be understood that there is an equivalent or corresponding element in the other of the two brackets. As seen in FIG. 1, the containment bracket 84*b* has an outer curved face 88*b* with a rim 92*b* extending inwardly therefrom. As seen with reference to containment bracket 84*a*, the rim 92*a* is used to define a recess 96*a*. Also defining the recess 96*a* is a ledge 100*a*. Each of the containment brackets 84*a*, 84*b* includes a pair of connector ears with containment bracket 84*a* having connector ears 104*a* and 104*a*' and containment bracket 84*b* having connector ears 104*b* and 104*b*'. Each of the containment brackets 84*a*, 84*b* has inserts joined to the connector ears. With respect to containment bracket 84*a*, insert 108*a* extends from the rim 92*a* to the ear 104*a*. Inserts 108*a*', 108*b*, 108*b*' are similarly disposed and positioned relative to their respective connector ears 104*a*', 104*b*, 104*b*'. As illustrated in FIG. 2, each insert acts to further the uniformity and aesthetics associated with the recoil pad subassembly 80. That is, the recoil pad subassembly 80 has cut-outs, material layers, ribs and membranes with each insert intended to provide conformance between the particular insert and adjacent cut-outs, material layers and membranes, see FIG. 2, for example. The containment brackets 84*a*, 84*b* are joined together using fastening screws 112*a*, 112*b*. The fastening screw 112*a* is received through aperture 116*b* formed in the connector ear 104*b* and aperture 116*a* formed in the connector ear 104*a*, while the fastening screw 112*b* is received through aperture 116*b*' formed in the connector ear 104*b*' and the aperture 116*a*' formed in the connector ear 104*a*'.

Each of the fastening screws 112*a*, 112*b* is connected to a fastening nut 114*a*, 114*b*, respectively. In the embodiment illustrated in FIG. 1, each of the fastener nuts 114*a*, 114*b* is positioned on the side of the connector ears 104*a*, 104*a*' that is away from the rim 92*a*.

The recoil pad subassembly 80 includes a recoil pad section 120 and an attachment bracket section 124. The recoil pad section 120 has a number of levels of cut-outs along the height thereof. Although the number of levels of cut-outs can vary, in one embodiment, there are three levels of cut-outs. Starting from the top surface 128 of the recoil pad subassembly 80, the first level of cut-outs 132 is formed in an essentially elliptical path around and just below the top surface 128. The second level of cut-outs 134 is formed just below the first level of cut-outs 132. The third level of cut-outs 136 is provided below the second level of cut-outs 134. Basically, the cut-outs 132, 134, 136 constitute air pockets where resilient material from the recoil pad subassembly 80 has been removed. The layers of material remaining are identified as first material layer 138, second material layer 140 and third material layer 142 (see FIGS. 3–5). In one embodiment, the recoil pad subassembly 80 is made of an elastomer, injection mold grade or Acrylyn injection moldable rubber for providing a relatively soft constituency while still providing the necessary strength for absorbing or cushioning, at least partially, shocks or forces, as will be explained in more detail later. The material remaining between the cut-outs 132, 134, 136 is defined as membranes and ribs. The membranes are substantially perpendicular to the longitudinal extent of the recoil pad subassembly and the ribs are substantially parallel thereto. The ribs are preferably thinner than the membranes, usually less than one-half the thickness of the membranes. The ribs 144 and membranes 146 are associated with the first level of cut-outs 132. The ribs 148 and membranes 150 are associated with the second level of cut-outs 136. The ribs 152 and the membranes 154 are associated with the third level of cut-outs 140. The ribs and membranes are best seen in FIGS. 3–5, which illustrate longitudinal sections through each of the three levels of cut-outs.

Figure 3:
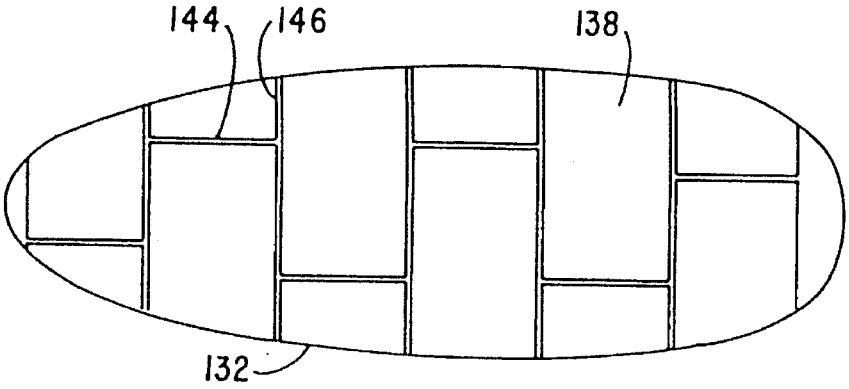
FIG. 3 is a longitudinal cross-section illustrating the first level of cut-outs and ribs.

As seen in FIG. 3, the cut-outs 132 are formed so that the ribs 144 are provided in an offset and staggered fashion on opposite sides of the longitudinal center axis associated with the recoil pad section 120. The membranes 146 associated with the first level of cut-outs 132 are formed substantially in the center or at mid-portions of the longitudinal extent of the cut-outs 134 and into the body of the recoil pad section 120.

Figure 4:
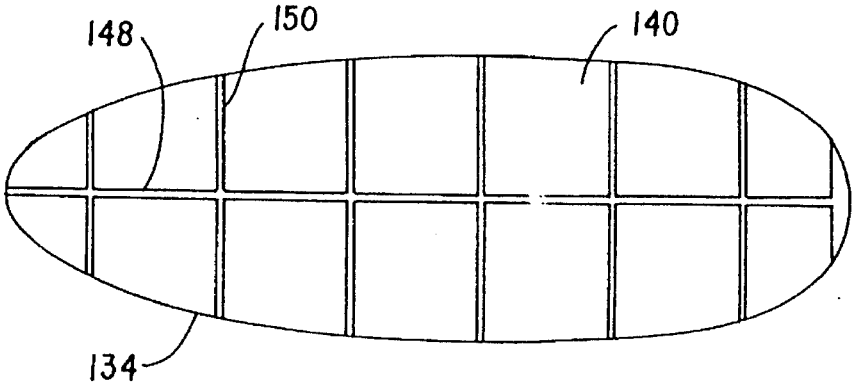
FIG. 4 is a longitudinal cross-sectional view illustrating the second level of cut-outs and ribs.

With reference to FIG. 4, the ribs 148 are positioned substantially along the longitudinal center axis of the recoil pad section 120. The membranes 150 are formed substantially at the center or along the midportions of the lateral extent of the cut-outs 132, as well as cut-outs 136, as seen in FIG. 2, for example.

Figure 5:
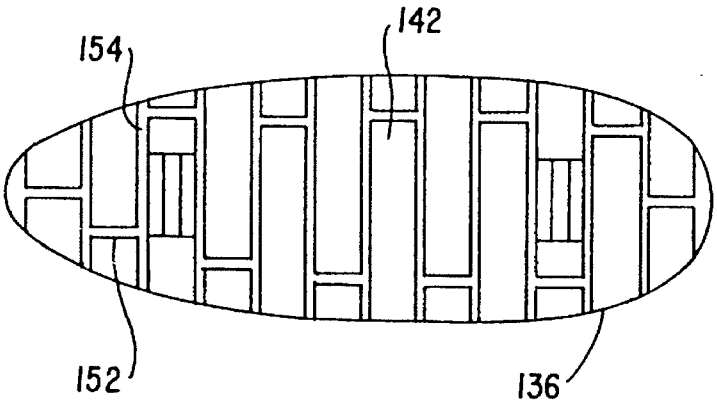
FIG. 5 is a longitudinal cross-sectional view illustrating the third level of cut-outs and ribs.
Figure 6:
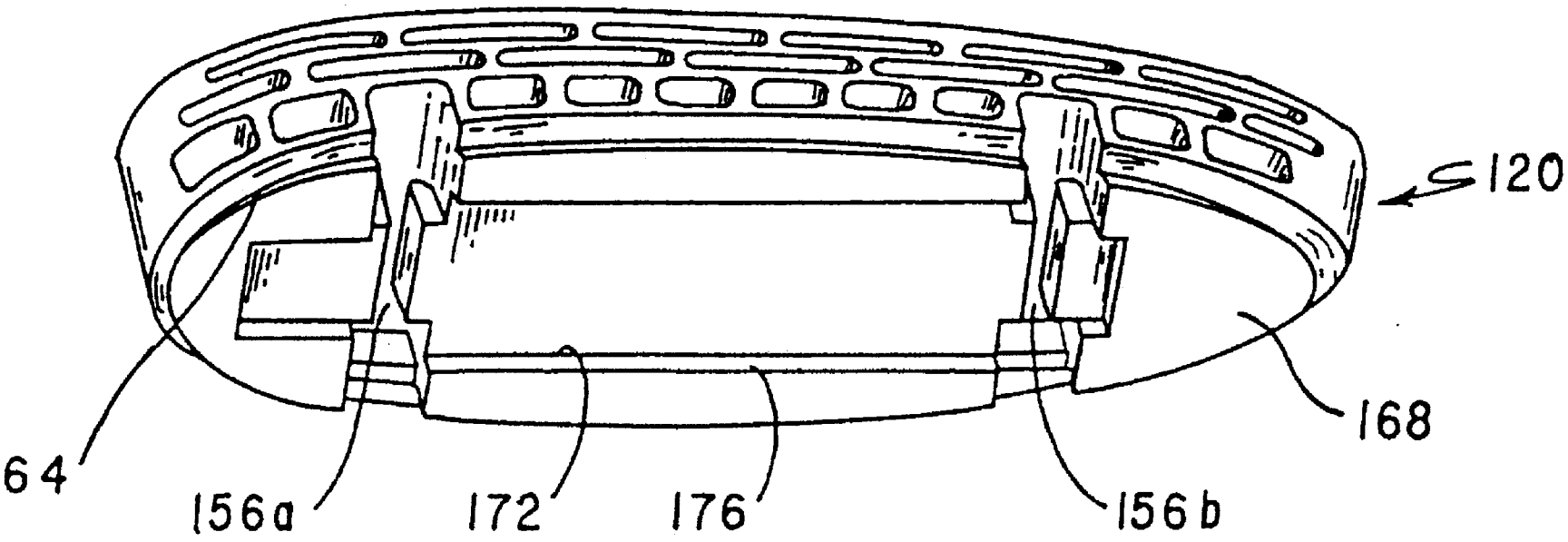
FIG. 6 is a perspective bottom view of the recoil pad subassembly showing the seat and periphery member.

With reference to FIG. 5, the ribs 152 are also offset from the longitudinal center axis of the recoil pad section 120 and the longitudinally extending membranes 154 are provided substantially along mid-portions of one-half of the lateral extent of the cut-outs 136. Consequently, the membranes 154 are disposed along two portions of the cut-outs 136. As seen in FIG. 1, the cut-outs 136 are narrower along their lateral extent than the cut-outs 132, 134 but have a greater height in a direction from the bottom of the cut-out to the top surface 128 of the recoil pad subassembly 80. Similarly, the cut-outs 134, even though they have a greater lateral extent than the cut-outs 136, have less lateral extension than the cut-outs 132 but the height of the cut-outs 134 is greater than the height of cut-outs 132. As seen in comparing FIGS. 3–5, there is more rib and membrane material associated with the third level of cut-outs 136 than the other two levels of cut-outs 132, 134. The amount of rib and membrane material associated with the second level of cut-outs 134 is slightly greater than the rib and membrane material for the first level of cut-outs 132. That is, ribs 148 and membranes 150 of the second level have a greater thickness than the ribs 144 and membranes 146 of the first level. The third level of the recoil pad section 120 provides the greatest strength and amount of rib and membrane material for absorbing forces or shocks, as well as sufficient size and strength to accommodate fasteners for use in affixing the recoil pad subassembly 80 to the stock 28. In that regard, formed in the third level of the cut-outs is a pair of connector slots 156*a*, 156*b* for receiving the connector ears 104*b*, 104*b*', respectively. The slots 156*a*, 156*b* extend into the recoil pad section 120, as seen in FIG. 6, for example.

The remaining two levels contribute a desired cushioning effect, with the first level having the ribs 144 offset from the longitudinal center axis of the recoil pad section 120, contributing to a relative and a desired softness in the area of the middle of the recoil pad section 120. That is, when the recoil pad section 120 is placed against the shoulder of a shooter and a force is received by the recoil pad section 120, the shooter will experience a softer contact or feel due to the off-setting and staggered configuration of the ribs 144.

The attachment bracket section 124 includes a groove 160 formed about the periphery of the recoil pad subassembly 80 just below the third level of cut-outs 136. Located just below the groove 160 is an outer wall 164 of the attachment bracket section 124. With reference to FIG. 6, extending from the outer wall 164 is a periphery member 168 formed at the bottom of the attachment bracket section 124. The periphery member 168 is disposed about the outer edge of the bottom of the recoil pad subassembly 80 and is used in defining a seat 172 that is a recessed area having a contour that substantially corresponds to the contour of the support face 40 of the mounting member 24. The seat 172 is somewhat larger than the support face 40 for providing the desired interaction and connection among the containment brackets 84*a*, 84*b* and the mounting subassembly 24, as will be subsequently discussed. In defining the contour of the seat 172, an inner wall 176 of the periphery member 168 is provided.

The connection of the recoil pad subassembly 20 to the stock 28 of the firearm 32 is next discussed with particular reference to FIGS. 1–2 and 7–8. The mounting bar subassembly 24 is aligned relative to the connecting pieces 60*a*, 60*b* so that holes 44*a*, 44*b* are aligned with bores 64*a*, 64*b*. After alignment, the connecting screws 68*a*, 68*b* are inserted into the aligned hole 44*a* and bore 64*a* and the aligned hole 44*b* and bore 64*b* to connect the mounting bar subassembly 24 to the stock 28. Upon construction, the heads of the connecting screws 68*a*, 68*b* are essentially flush with the support face 40 of the mounting subassembly 24 while the shafts of these screws extend into the bores 64*a*, 64*b*.

With reference to FIG. 2, as well as FIG. 1, the containment brackets 84*a*, 84*b* are joined to the attachment bracket section 124 of the recoil pad subassembly 80. Specifically, rims 92*a*, 92*b* are fitted into the groove 160 so that outer wall 164 is received into the recesses 96*a*, 96*b* of the containment brackets 84*a*, 84*b*. It should be understood that the rims 92*a*, 92*b* could be slightly angled to assist in pulling the recoil pad subassembly 80 down and in. The amount of the angle would be in the order of the 5° angle of the ramping surfaces 56*a*, 56*b*. The ledges 100*a*, 100*b* support or underlie portions of the periphery member 168.

Figure 9:
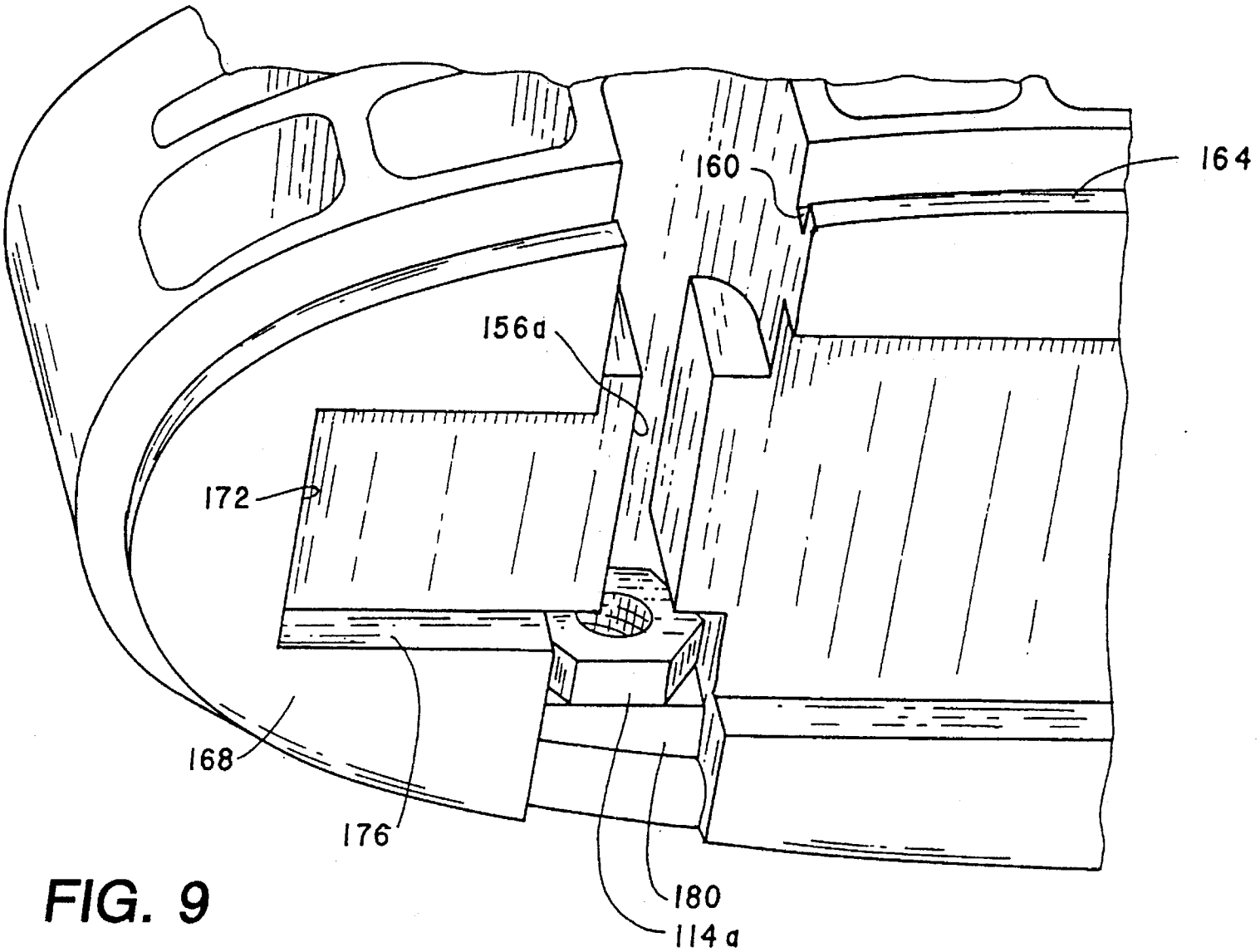
FIG. 9 is an enlarged, fragmentary perspective view of the bottom of the recoil pad subassembly illustrating the hidden-from-view location of the fastening nut.

With reference also to FIG. 9, each of the fastening nuts 114*a*, 114*b* is positioned in the pathway of the fastening screws 112*a*, 112*b* in front of a barrier member 180, which acts to hide the fastening nuts from view in order to provide a more aesthetically pleasing appearance of the recoil pad subassembly 80 when it is connected to the stock 28. Additionally, the section in which each nut 114*a*, 114*b* is received, closely corresponds to the nut size to provide a tight fit whereby the nut does not turn when the fastening screws 112*a*, 112*b* are tightened into the nuts 114*a*, 114*b*. Each of the connector ears 104*a*, 104*b* is positioned into the connector slot 156*a* and each of the connector ears 104*a*', 104*b*' is positioned into the connector slot 156*b*. The fastening screws 112*a*, 112*b* are inserted through the connector ears 104*b*, 104*b*' to be threadably received by the fastening nuts 114*a*, 114*b*, respectively.

Figure 8:
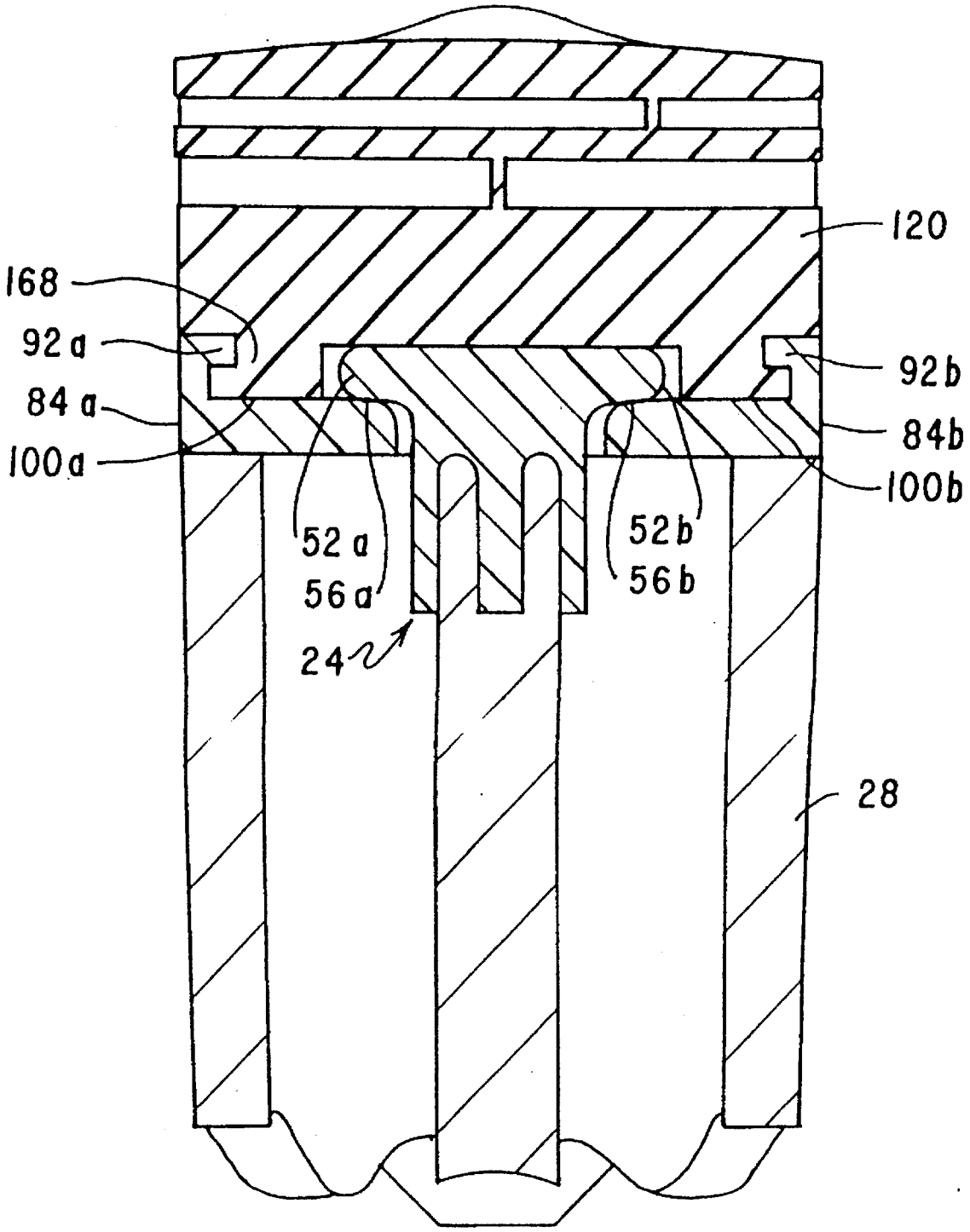
FIG. 8 is a lateral cross-sectional view illustrating a second position of the containment brackets relative to the ramping surfaces.
Figure 10:
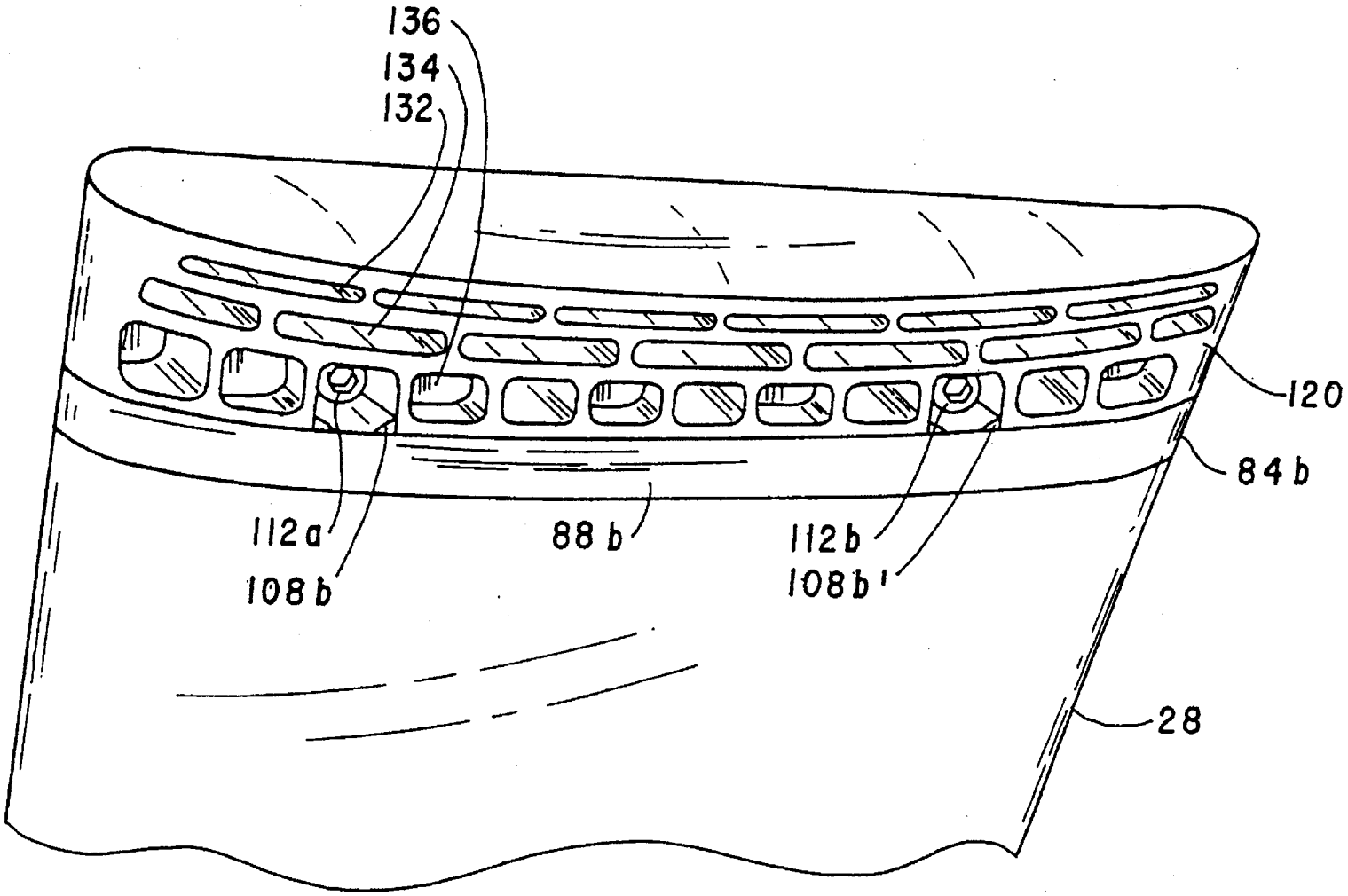
FIG. 10 is a perspective view of the recoil pad assembly connected to the stock.

The recoil pad subassembly 80 and the containment brackets 84*a*, 84*b* are connected to the mounting bar subassembly 24 for connection to the stock 28. In that regard, the body 36 and the support face 40 of the mounting bar subassembly 24 are received by the seat 172. With reference to FIGS. 7 and 8, the fastening screws 112*a*, 112*b* are tightened using the fastening nuts 114*a*, 114*b* thereby drawing or bringing together, inwardly of the recoil pad subassembly 80, each of the containment brackets 84*a*, 84*b*. As the ledges 100*a*, 100*b* are drawn closer to each other, they contact and engage the ramping surfaces 56*a*, 56*b* of the ramp members 52*a*, 52*b*, respectively of mounting subassembly 24. Because of the angle of the ramping surfaces, the recoil pad subassembly 80, together with each of the containment brackets 84*a*, 84*b*, are drawn or moved inwardly and downwardly relative to the firearm stock 28. This inward and downward movement causes the recoil pad subassembly 80 and the containment brackets 84*a*, 84*b* to be drawn preferably flush with the outer surface of the stock 28, as seen in FIG. 10, as well as providing the desired connection. This manner of connection also permits the connection of the same recoil pad subassembly 80 to somewhat or slightly different stocks since the inward and downward bringing together of the recoil pad subassembly 80 and the containment brackets 84*a*, 84*b* overcomes or compensates for such differences while providing the desired attachment and flushness. As also can be appreciated, the seat 172 being slightly wider than the support face 40 enables the resilient periphery member 168 to be drawn closer to and about the support face 40 as the fastening screws 112*a*, 112*b* are tightened.

Figure 11:
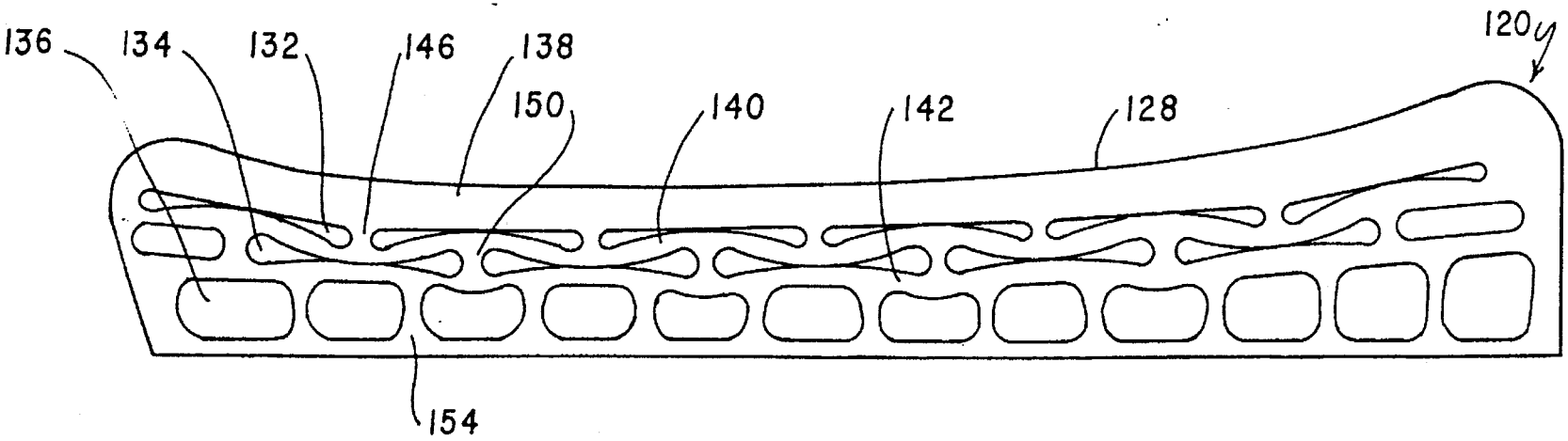
FIG. 11 is a side elevational view of the recoil pad subassembly illustrating the progressive collapsibility aspect thereof due to the cut-outs and membranes when the firearm is discharged.
Figure 12:
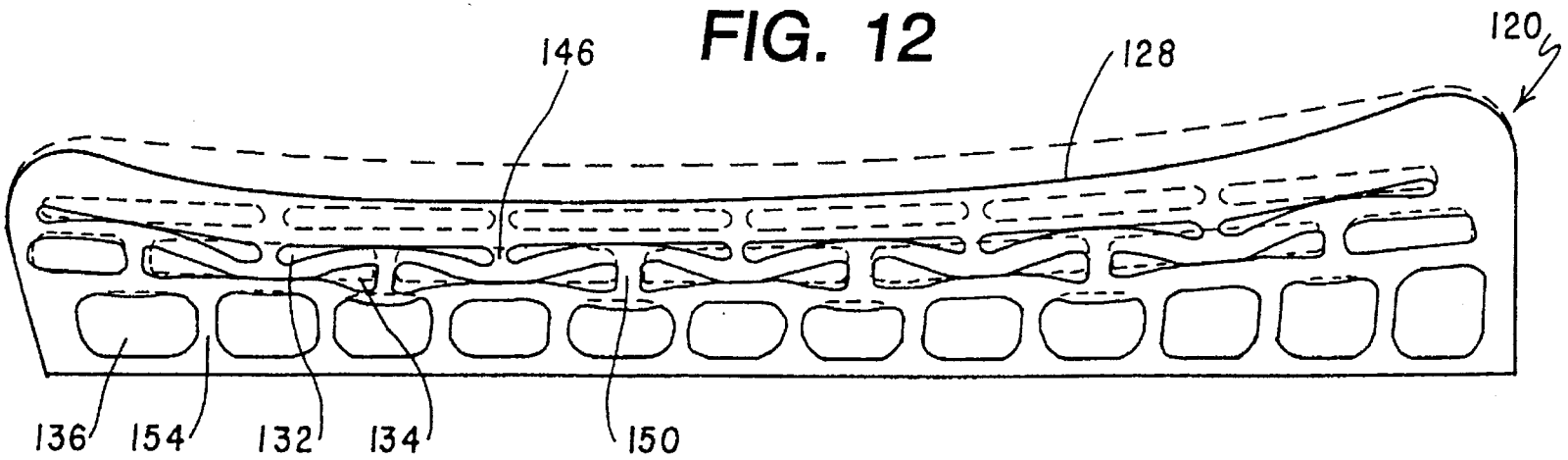
FIG. 12 is a side elevational view similar to FIG. 11 but also showing the uncollapsed recoil pad subassembly in phantom lines.
Figure 13:
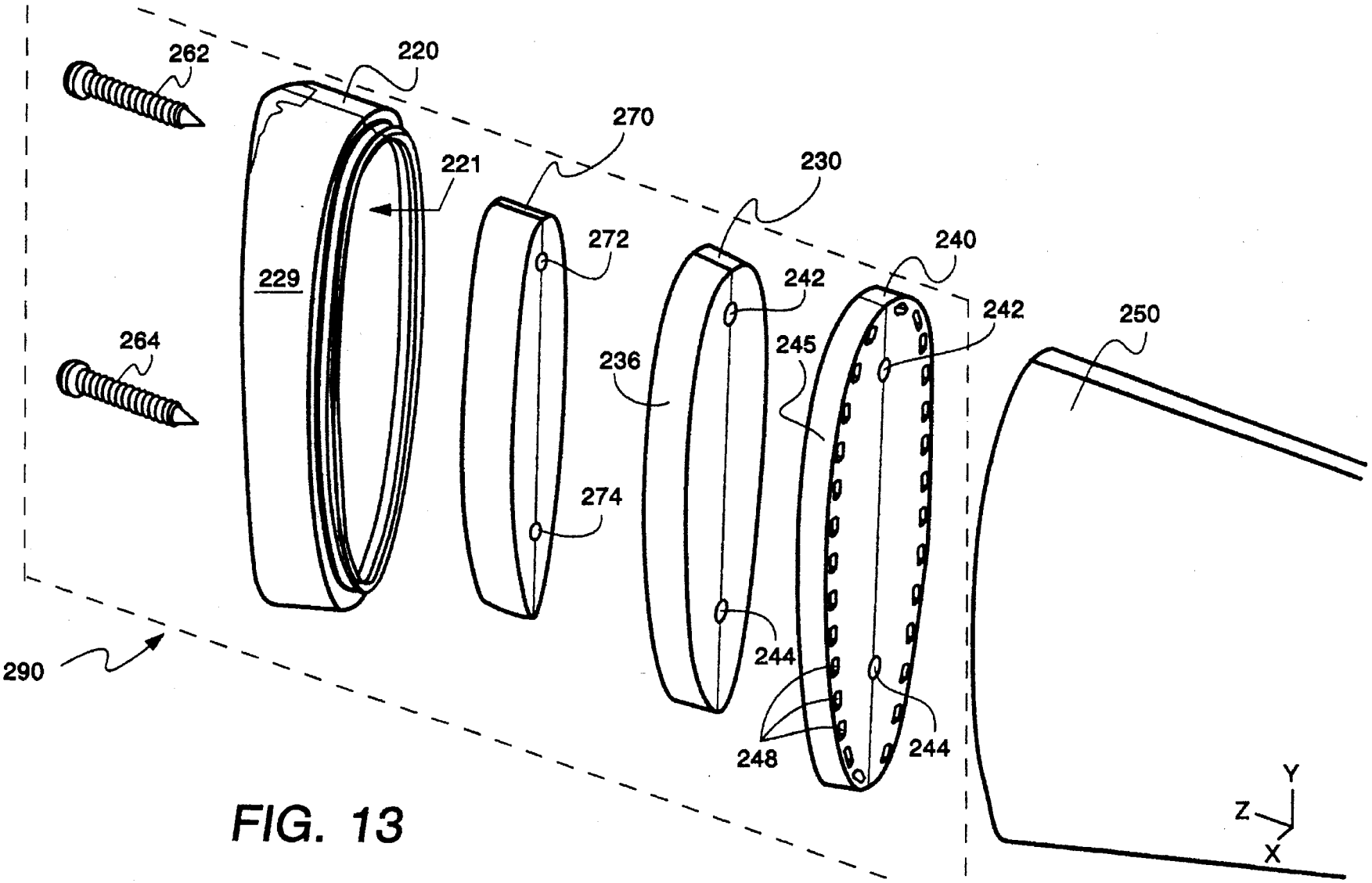
FIG. 13 is an exploded view of one embodiment of an attachment scheme of the present invention.

With respect to the shooting of the firearm and the use of the recoil pad assembly 20 for reducing the impact of the recoil force generated by the firearm, reference is made to FIGS. 11 and 12. When impact force is applied to the recoil pad subassembly 80, the third level of cut-outs 140 receives the initial impacting force from stock 28 through containment brackets 84*a*, 84*b*. Due to the fact that the cut-outs 136 are smaller than the cut-outs 132, 134 and the fact that the ribs 152 and membranes 154 are thicker, a great deal of the energy is transferred without considerable absorption. This higher rigidity allows for appropriate clamping by the containment bracket rims 92*a*, 92*b*. The second layer cut-outs 134 are designed such that the membranes 150 are longer and the ribs 148 thinner than the membranes 154 and ribs 152 of the third level of cut-outs. Thus, less structure is available for stiffness, i.e., more bending of the membranes is apparent and some deflection of the ribs is apparent. Moderate recoil absorption occurs due to bending. Most of the softness and recoil absorption is in the first layer of cut-outs 132 due to the fact that such cut-outs 132 are long within thin ribs 144. It is possible that some of the cut-outs actually collapse fully due to localized forces. It should be further understood that the construction of the present invention also accounts for the fact that side and end walls are designed structurally weak to allow for deflection under bending moment. Thus, it is seen that a progressive collapsing of the recoil pad subassembly 80 occurs such that most of the softness and deflection is in the first and second layers, with the highest softness and deflection being experienced by the first layer which is against the shoulder of the shooter. Because of this collapsing function, together with the offsetting of the ribs 144 in the first level of cut-outs 132, a relatively softer force is applied to and felt by the shooter. This results in less discomfort to the shooter and enables the shooter to fire more rounds while reducing discomfort or limiting the amount of force experienced over the number of rounds that are shot.

In greater detail referring to the collapsing nature of the recoil pad section 120, it is seen in FIGS. 11 and 12 that there is a movement or shift of the top surface 128 and the first material layer 138 towards the cut-outs 132 whereby the mid-portions of the cut-outs 132 are compressed together and portions of the first material layer 138 contact portions of the second material layer 140. The membranes 146, 150 of the first and second layers of cut-outs 132, 134, respectively, deflect. The deflection of the membranes 146, 150, together with the collapsing of first and second material layer 138, 140 portions produces a series of peaks and valleys associated with the second material layer 140. The peaks are defined adjacent to the membranes 150 and the valleys are defined adjacent to the membranes 146. Similarly, but less pronounced, peaks and valleys are generated associated with the third material layer 142. The peaks are defined adjacent to the membranes 146 and the valleys are defined adjacent to the membranes 150. As illustrated in the figures, there is slight collapsibility of at least some of the cut-outs 136 adjacent to the membranes 150 of the second layer. As can be understood, along the height of the recoil pad section 120, the membranes and cut-outs are arranged to collapse in a predetermined way in order to provide desired support for absorbing, at least partially, the recoil force of the firearm when it is fired.

The cut-outs 132, 134, 136 also serve a further function during the preferred manufacturing of the recoil pad subassembly. Specifically, such cut-outs act to suitably remove excess polymer or rubber material such that sinkage and warpage are reduced during injection molding of the recoil pad subassembly 80, which is the preferred form of manufacture. Prior art processes are mostly cast rubber which have flashing and bubbles which must be mechanically removed by grinding. This, of course, adds to the time and cost of manufacture. The injection molding of the present invention is also advantageous in maintaining tolerances for fit to the butt end of the stock and promotes the desired cosmetic appearance thereof.

The foregoing description of the invention has been presented for purposes of illustration and discussion. Further, the description is not intended to limit the invention to the form disclosed herein. Consequently, variations and modifications commensurate with the above teachings, within the skill and knowledge of the relevant art, are within the scope of the present invention. The embodiment described hereinabove is further intended to explain the best mode presently known of practicing the invention and to enable others skilled in the art to utilize the invention in such, or other embodiments, and with the various modifications required by their particular applications or uses of the invention. It is intended that the appended claims be construed to include alternative embodiments to the extent permitted by the prior art.

Based on the foregoing detailed description, a number of salient features of the present invention are immediately recognized. A recoil pad assembly is disclosed for absorbing or cushioning in a unique manner the recoil force from a firearm when it is fired. The recoil pad assembly includes containment brackets to facilitate connection of the recoil pad to the firearm stock. The containment brackets, together with the recoil pad itself, contribute to fitting the recoil pad assembly to slightly different firearm stocks. That is, as the containment brackets are tightened, the resilient recoil pad is pulled or fitted into the stock to accommodate slight size differences. As a result, the shooter is able to reduce time and cost associated with grinding down an oversized recoil pad so that it will properly fit the stock. It should be appreciated, however, that a greater than insubstantial size difference between stocks would require a different sized recoil pad. The recoil pad assembly also includes different levels of cut-outs formed along the height of the recoil pad to achieve progressive collapsing of the recoil pad and thereby achieve a cushioning effect to the recoil force generated by the shooting of the firearm. Another important aspect of the layers of cut-outs relates to forming the top level of cut-outs so that the ribs are staggered and offset relative to the longitudinal center axis of the recoil pad. Consequently, because there is substantially less ribs along the center portions of the recoil pad, it is softer to the touch and the shooter is expected to experience less discomfort and force when the firearm is discharged. Although the cut-outs may aesthetically appear like prior recoil pad designs, they are not since they are specifically structured to deliberately deflect in a predetermined way. Ideally, the third level of cut-outs is sufficiently strong to properly receive and hold the fastening screws while still providing some degree of collapsibility to absorb some force caused by the discharging firearm. The first and second levels provide greater absorption of force capability with the first level collapsing the most and providing the desired softness.

In another embodiment of the present invention, a resilient recoil pad is attached to the stock end of a firearm without the use of external brackets. FIGS. 13–18 illustrate one embodiment of this attachment scheme. As shown in the exploded views of FIGS. 13 and 14, the recoil pad subassembly 290 which is to be attached to stock 250 comprises: recoil pad 220, foam insert 270, locking plate 230, base plate 240, and fastening screws 262 and 264.

In this embodiment, recoil pad 220 is preferably made of a resilient elastomer and includes a rib 226 which is disposed along the outer edge of its base. Rib 226 is connected to side wall 229 of recoil pad 220 by rib extender 228 which comprises a thin wall and defines a groove between rib 226 and side wall 229. Side wall 229 extends around the periphery of recoil pad 220 and connects to upper wall 227. Upper wall 227, side wall 229, rib extender 228, and rib 226 combine to define a cavity 221 shaped to receive foam insert 270 and locking plate 230. Unlike prior attachment schemes, the recoil pad 220 of the present invention does not need to be machined or shaved down to match the exact specifications of stock 250. As will be explained, slight manufacturing variations can be accounted for during attachment of recoil pad subassembly 290 to stock 250.

Initially, foam insert 270 is placed into cavity 221 of recoil pad 220. Locking plate 230 is then inserted into cavity 221 compressing foam insert 270 against the upper wall 227 of recoil pad 220. Foam insert is preferably constructed of a compressible material, and locking plate 230 is a rigid member constructed to be substantially the same shape as cavity 221. Locking plate 230 must compress foam insert 270 sufficiently such that recoil pad rib 226 can be deformed to fit into base plate 240. Locking plate 230 is of sufficient size that if rib 226 is disposed around its periphery, recoil pad 220 will not fit easily into base plate 240. Note that in FIG. 15 some space is left between locking plate 230 and base plate 240 in order to bend the outside wall 229 of recoil pad 220 and thereby fit recoil pad rib 226 inside of side wall 245 of base plate 240. Foam insert 270 is not shown in FIGS. 15–17 so that locking plate 230 can be shown clearly.

Since recoil pad 220 is made of a resilient elastomer, rib 226 asserts a force radially outward against the side wall 245 of base plate 240, thereby holding recoil pad 220 in place. Rib 226 need only be large enough in perimeter to assert a force on side wall 245 when recoil pad 220 is deformed to fit into base plate 240. Recoil pad 220 must also be sufficiently small so that it may be deformed enough to fit rib 226 inside side wall 245 of base plate 240. Depending on the elastomer used in construction of recoil pad 220, this should be a large enough tolerance to account for most variations due to manufacturing inconsistencies.

Two screws 262 and 264 are inserted through holes 222 and 224 in upper wall 227 of recoil pad 220. The screws pass through holes 272 and 274 of foam insert 270 (not shown), 232 and 234 of locking plate 230, 242 and 244 of base plate 240, and into threaded holes 252 and 254 of stock 250. Note that holes 222,224,272, and 274 must be large enough so that the heads of screws 262 and 264 can pass through them without pulling either upper wall 227 or foam insert 270 down as they are screwed in.

Figure 16:
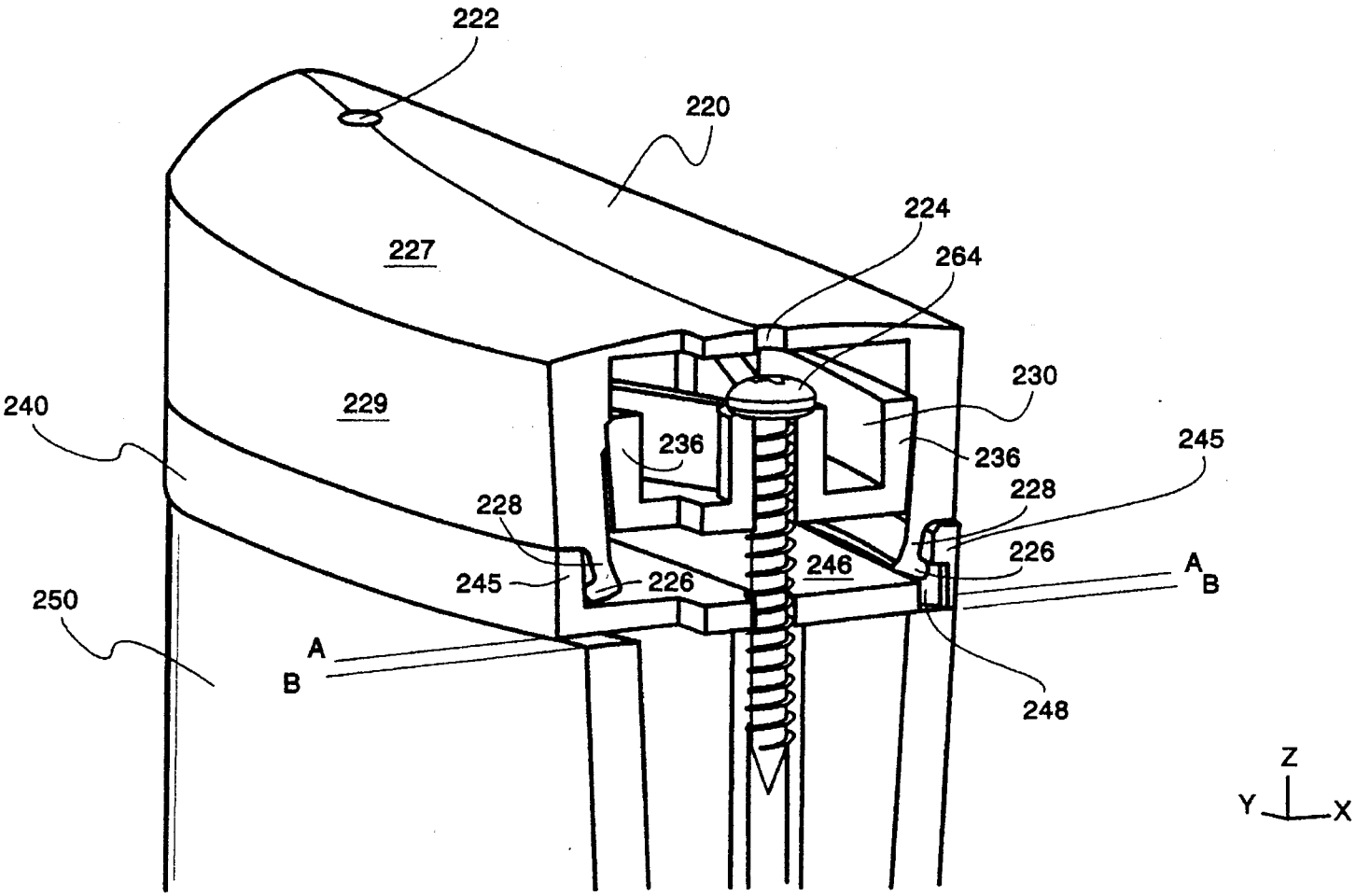
FIG. 16 is a cross-sectional view of a second stage of an attachment scheme of the present invention.

In FIG. 16, recoil pad 220 has been forced downward so as to bring recoil pad rib 226 in contact with the lower wall 246 of base plate 240. Also, screws 262 and 264 have been threaded into holes 252 and 254 so that the heads of screws 262 and 264 are in contact with locking plate 236. As shown, side wall 236 of locking plate 230 and side wall 245 of base plate 240 are preferably constructed to flare outwardly at an angle of approximately five degrees from vertical. The reason for this will become apparent from the following description.

Figure 14:
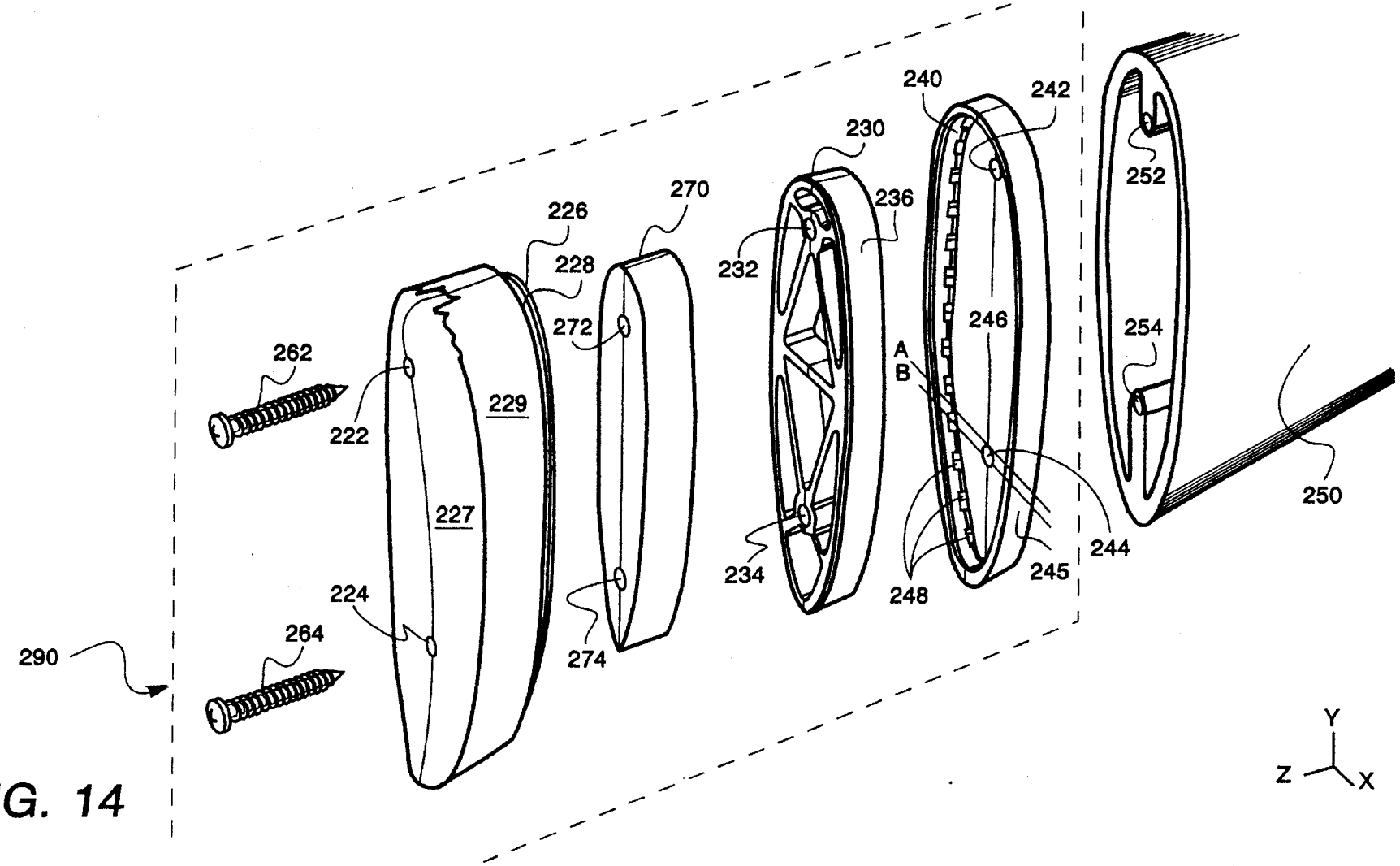
FIG. 14 is an exploded view of the same embodiment shown from a different angle.
Figure 15:
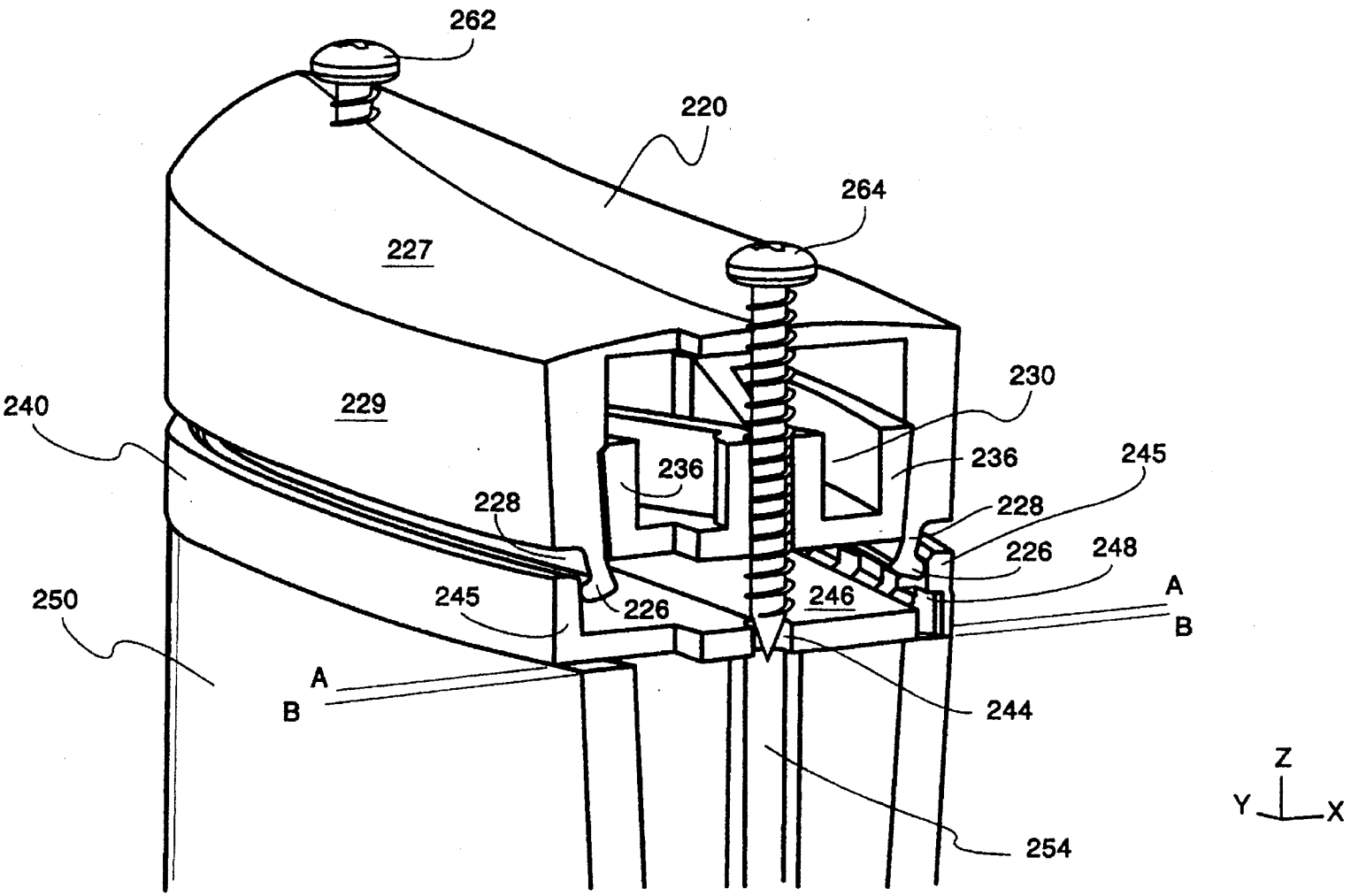
FIG. 15 is a cross-sectional view of a first stage of an attachment scheme of the present invention.
Figure 17:
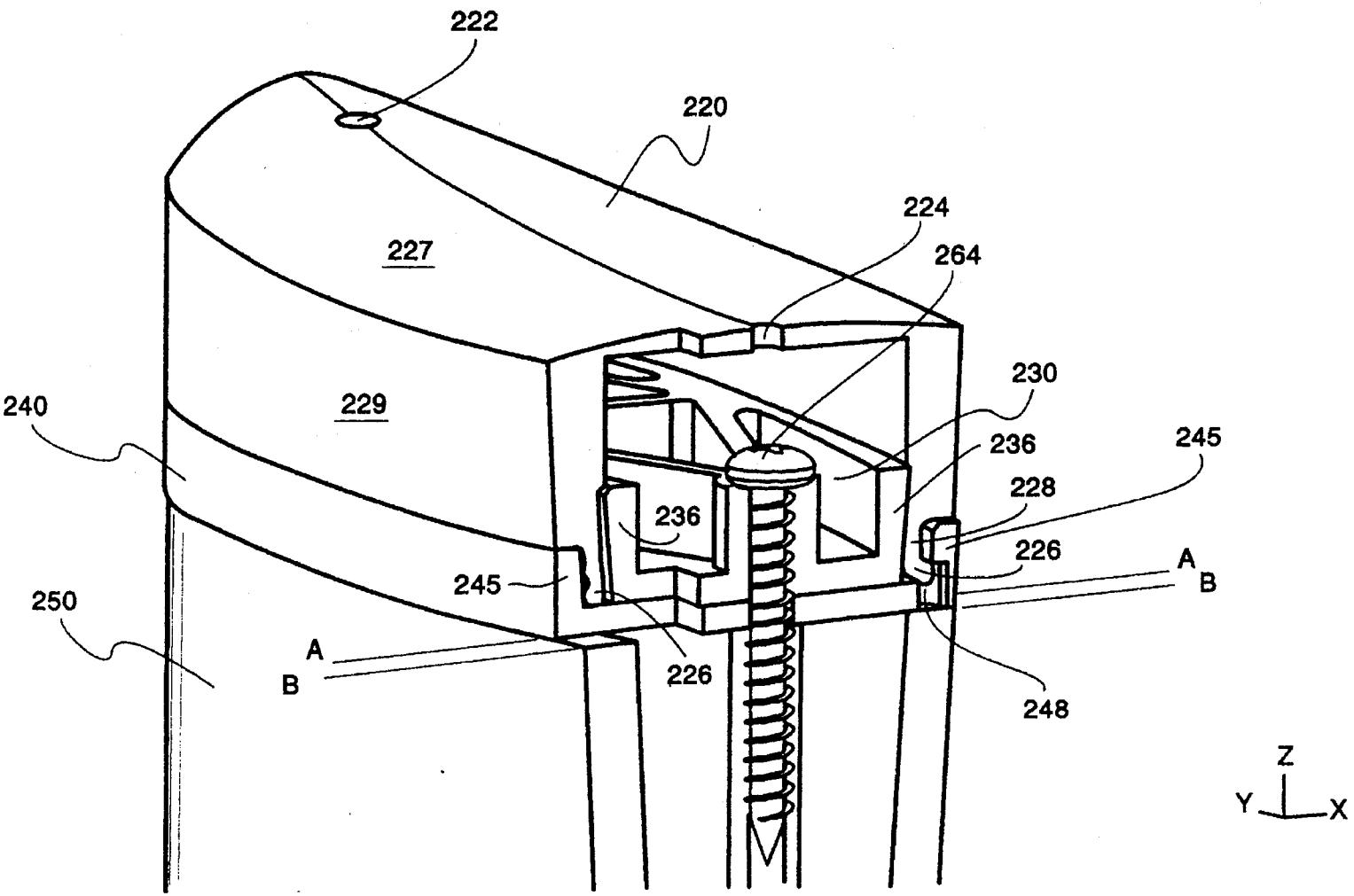
FIG. 17 is a cross-sectional view of a fully attached recoil pad according to one embodiment of an attachment scheme of the present invention.

Base plate 240 is constructed with a rigid material such as a hard plastic shaped to substantially match the form of firearm stock 250. A plurality of apertures 248 are provided around the periphery of base plate 240 where lower wall 246 and side wall 245 converge. The apertures 248 extend partially into side wall 245 and completely through the bottom of lower wall 246. In FIGS. 15–17, a cross-section of the recoil pad subassembly is taken at lines A—A and B—B which are also shown in FIG. 14. Note that line B—B passes directly through one of the apertures 248 in base plate 240 while line A—A passes through base plate 240 between apertures 248.

As screws 262 and 264 are tightened, locking plate 230 is forced downward towards base plate 240. As locking plate 230 moves downward, side wall 236 compresses rib 226 and rib extender 228 against the side wall 245 of base plate 240. In the areas where base plate 240 contains apertures 248, rib 226 is forced outward and downward into the apertures 248. In the areas of base plate 240 between apertures 248, rib 226 is compressed against side wall 245. The exact configuration of rib 226 in these areas in between apertures 248 is dependent on friction and cannot be completely predicted. Note that the tapering of side walls 236 and 245 helps force rib 226 downward as well as outward into apertures 248. Note also that since both side walls 236 and 245 are tapered at the same angle, rib extender 228 and/or rib 226 are compressed with a substantially constant pressure along the height of side wall 245. If side wall 245 were not tapered, the pressure on rib extender 228 would be greatest at the top of side wall 245, and the attachment of recoil pad 220 to base plate 240 would not be as strong.

FIG. 17 depicts the recoil pad subassembly when it is fully attached to stock 250. Screws 262 and 264 are tightened so that locking plate 230 is flush with base plate 240. In the areas where rib 226 is forced into apertures 248, rib extender 228 is compressed between side walls 236 and 245, thereby creating a tensile force which helps force rib 226 downward and outward into apertures 248. Thus, any force which attempts to pull recoil pad 220 away from base plate 240 will be opposed in two ways. First, a frictional force will be created between rib extender 228 and/or rib 226 and side walls 236 and 245. Second, in the areas in which rib 226 extends into apertures 248, a force opposing the removal of recoil pad 220 is asserted by the edges of the apertures 248 formed in base plate 240. In order to remove recoil pad 220 from base plate 240, rib 226 must be forced both inward and upward. Since rib 226 extends downward into aperture 248 after final construction, the edge of lower wall 246 of base plate 240 which defines the apertures 248 will oppose any inward motion of rib 226. In addition, since rib 226 extends outward into aperture 248 after final construction, the edge of side wall 245 which defines the upper boundary of aperture 248 will oppose any upward motion of rib 226. Recoil pad 220 is therefore effectively locked into base plate 240 which is affixed to stock 250 by screws 262 and 264.

Figure 18:
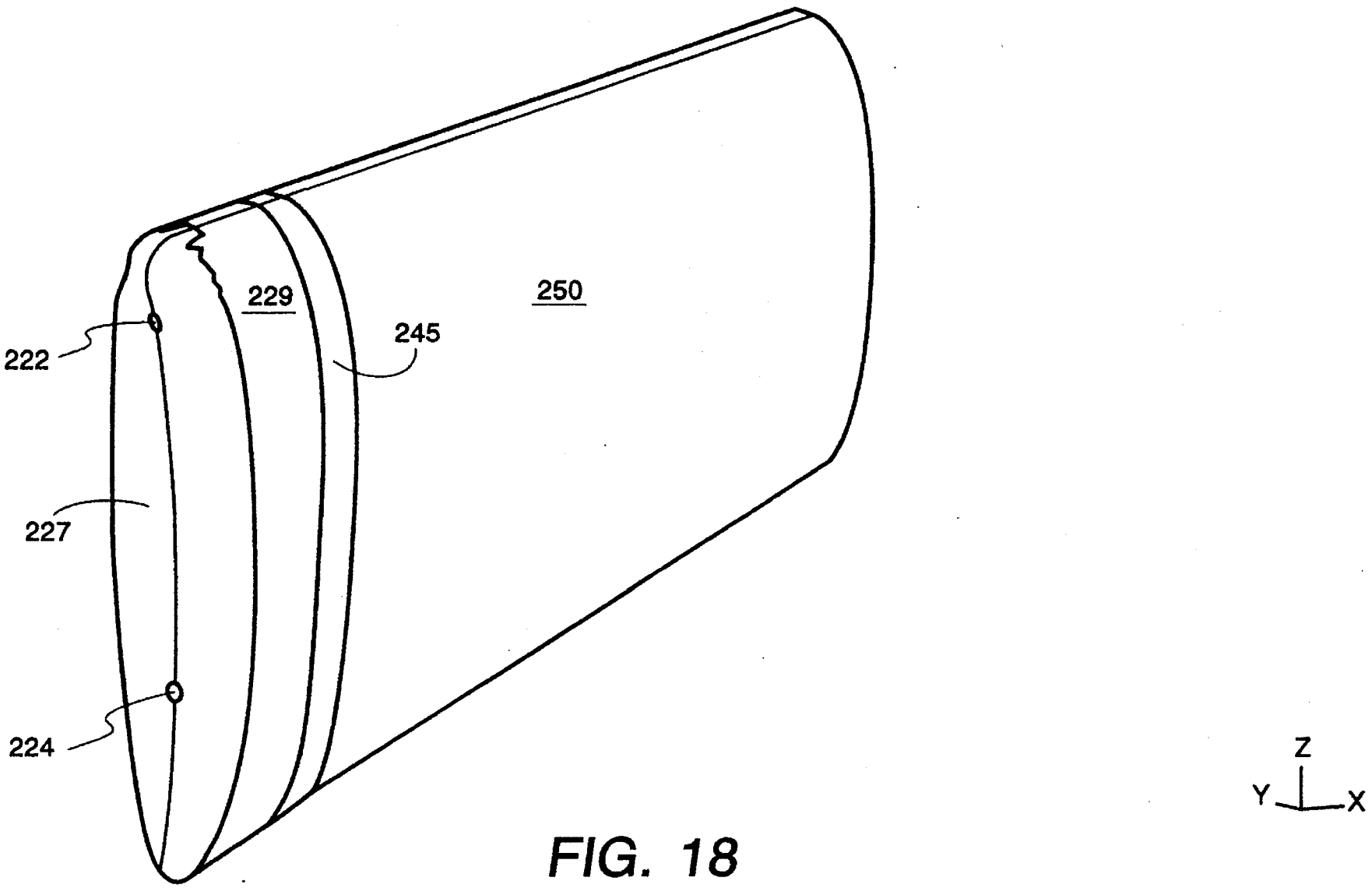
FIG. 18 illustrates a fully attached recoil pad according to one embodiment of the present invention.

FIG. 18 illustrates the recoil pad subassembly 290 fully attached to stock 250. Note that the attachment scheme of the present invention forces side wall 229 of recoil pad 220 to be flush with side wall 245 and therefore stock 250.

It should be noted that as locking plate 230 is forced downward by screws 262 and 264, foam insert 270 (not shown) expands to fill the space between upper wall 227 and locking plate 230. Also, in another embodiment, foam insert 270 is not used. Instead, once the recoil pad subassembly has been attached to stock 250, as in FIG. 20, foam is injected via a needle through upper wall 227 to fill the space between upper wall 227 and locking plate 230.

Although the present invention has been described with reference to the preferred embodiments, one of ordinary skill in the art will recognize that changes can be made without departing from the scope and spirit of the present invention as defined by the appended claims.

What is claimed is:

1. A recoil pad assembly for attachment to a stock of a firearm, comprising:

a resilient recoil pad subassembly for use in absorbing a recoil force produced by the firearm, said recoil pad subassembly having bottom portions;

a mounting subassembly engaging said recoil pad subassembly and adapted to be connected to the stock of the firearm; and locking means including a locking plate for connecting said recoil pad subassembly to said mounting subassembly, said locking means also including fastening means for causing said bottom portions of said recoil pad subassembly to be compressed between said locking plate and said mounting subassembly, wherein said mounting subassembly includes a support face having a periphery and a side wall extending around said periphery and with a plurality of apertures formed in said side wall and, when said bottom portions of said recoil pad subassembly are compressed, said recoil pad subassembly bottom portions are moved vertically and laterally and at least some of said bottom portions are positioned in said apertures.

2. The recoil pad assembly of claim 1, wherein said recoil pad subassembly comprises;

a recoil pad casing comprising an upper wall, a continuous side wall, a recessed wall, and a rib connected to said continuous side wall by said recessed side wall, wherein said bottom portions of said recoil pad subassembly comprise at least said rib and said recessed wall.

3. The recoil pad assembly as recited in claim 1, wherein:

said recoil pad subassembly includes a recoil pad casing and said bottom portions being compressed comprise a rib extending along an outer edge of a lower side of said casing, and wherein at least portions of said rib are forced into said apertures by said vertical and lateral movements of said recoil pad subassembly.

4. The recoil pad assembly as recited in claim 3, wherein:

after said rib is forced into said apertures, said apertures inhibit both vertical and lateral movement of said recoil pad subassembly.

5. The recoil pad assembly as recited in claim 1, wherein:

said apertures are disposed at a convergence of said support face and said side wall and extend only partially into said side wall and completely through said support face.

6. The recoil pad assembly as recited in claim 1, wherein said locking plate comprises:

a rigid member comprising an upper face, a lower face, and a continuous side wall, wherein said upper face is larger in area than said lower face and said continuous side wall is tapered at a first angle to connect said upper and lower faces; and wherein said side wall of said mounting subassembly is also tapered at said first angle such that when said lower face is flush with said support face, the distance between said side wall of said locking plate and said side wall of said mounting subassembly is substantially constant.

7. The recoil pad assembly of claim 1, wherein said recoil pad subassembly includes a compressible material for cushioning a shoulder of a shooter when the firearm is discharged.

8. The recoil pad assembly of claim 7, wherein said compressible material comprises a foam member inserted into said recoil pad subassembly before attaching said recoil pad subassembly to said mounting subasssembly.

9. The recoil pad assembly of claim 7, wherein said compressible material comprises foam injected into said recoil pad subassembly after said recoil pad subassembly is attached to said mounting subassembly.

10. A method for attaching a recoil pad assembly to a stock of a firearm using a recoil pad subassembly and a mounting subassembly having apertures, comprising:

positioning said mounting subassembly having apertures relative to the firearm stock;

locating said recoil pad subassembly adjacent to said mounting subassembly, said recoil pad subassembly having bottom portions; and connecting said recoil pad subassembly to said mounting subassembly and firearm stock by moving at least some of said bottom portions toward and into said mounting subassembly apertures, said some of said bottom portions being located in said apertures after said connecting step is completed.

11. The method as recited in claim 10, wherein:

said step of connecting includes moving a locking plate downward toward said mounting subassembly.

12. The method as recited in claim 11, wherein:

said step of connecting includes moving said bottom portions of said recoil pad subassembly in both vertical and lateral directions using said locking plate in connecting said recoil pad subassembly to the firearm stock and said mounting subassembly and with said bottom portions being located between said locking plate and said mounting subassembly.

13. The method recited in claim 10, wherein:

said step of connecting includes causing said bottom portions of said recoil pad subassembly to move outwardly and downwardly relative to the firearm stock.

14. The method as recited in claim 10, wherein:

said step of connecting includes tightening fastening means positioned to connect said mounting subassembly to the firearm stock and to the recoil pad subassembly.

15. A recoil pad assembly for attachment to a stock of a firearm, comprising:

a resilient recoil pad subassembly for use in absorbing a recoil force produced by a firearm, said recoil pad subassembly including bottom portions; and connecting means for connecting said recoil pad subassembly to the firearm stock, said connecting means including a plurality of apertures and means for locating at least some of said bottom portions of said recoil pad subassembly in said apertures wherein said some bottom portions are positioned in said apertures when said recoil pad subassembly is connected to the firearm stock.

16. The recoil pad assembly as recited in claim 15, wherein:

said apertures are formed in a mounting subassembly of said connecting means and said means for locating includes a locking plate and in which said bottom portions are located between said locking plate and said mounting subassembly.

17. The recoil pad assembly as recited in claim 15, wherein:

said connecting means includes fastening means for forcing said some bottom portions into said apertures.

18. The recoil pad assembly as recited in claim 17, wherein:

said fastening means forces said bottom portions outwardly relative to the firearm stock wherein said some bottom portions are received in said apertures.

19. The recoil pad assembly as recited in claim 15, wherein:

said apertures are formed in a mounting subassembly of said connecting means and said mounting subassembly includes a side wall and a support face and in which said apertures extend only partially into said side wall and completely through said support face.

* * * * *